US006193355B1

(12) United States Patent
Nakamura

(10) Patent No.: US 6,193,355 B1
(45) **Date of Patent: *Feb. 27, 2001**

(54) INK JET RECORDER

(75) Inventor: Hirotake Nakamura, Nagoya (JP)

(73) Assignee: Brother Kogyo Kabushiki Kaisha, Nagoya (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/130,511

(22) Filed: Aug. 7, 1998

(30) Foreign Application Priority Data

Aug. 8, 1997 (JP) ..... 9-215157

(51) Int. Cl.[7] ..... B41J 2/165; B41J 2/19
(52) U.S. Cl. ..... 347/30; 347/35; 347/92
(58) Field of Search ..... 347/30, 33, 86, 347/35, 92, 23, 85, 93

(56) References Cited

U.S. PATENT DOCUMENTS 5,481,289 * 1/1996 Arashima et al. ..... 347/93
5,565,899 * 10/1996 Sugimoto et al. ..... 347/30
5,677,718 * 10/1997 Crawford et al. ..... 347/92
5,847,726 * 12/1998 Hori ..... 347/23
5,889,536 * 3/1999 Sasaki ..... 347/30
5,896,143 * 4/1999 Matsui et al. ..... 347/30

FOREIGN PATENT DOCUMENTS 8-252927 * 10/1996 (JP) .
8-258286 * 10/1996 (JP) .

* cited by examiner

*Primary Examiner*—N. Le
*Assistant Examiner*—Judy Nguyen
(74) *Attorney, Agent, or Firm*—Oliff & Berridge, PLC

(57) ABSTRACT

An ink jet recorder includes: a recording head; an ink cartridge detachably attached to the recording head; a purging device for purging the nozzle of the recording head; and a carriage for holding the recording head and conveying it across the width of a recording medium and an area outside the medium; and a controller. Provided in an area outside the medium is an ink receiver for receiving the ejection of ink for flushing. The controller controls the carriage with the recording head in such a manner that, before purging is started by the purging device, the carriage is moved to a position where the recording head opposes the ink receiver and then the recording head ejects ink for flushing. Air bubbles generated in the joint passage formed between the recording head and the ink cartridge when they are fitted to each other, can be displaced into the recording head by flushing, and the thus flushed air bubbles can be suctioned together with ink by purging.

18 Claims, 8 Drawing Sheets

INK JET RECORDER

BACKGROUND OF THE INVENTION

1. Field of the Invention

The present invention relates to an ink jet recorder for recording images etc., on recording media with ejected ink, and more specifically relates to an ink jet recorder having a purging device for purging the recording head and a flushing device for removing air bubbles inside the recording head.

2. Description of the Related Art

Ink jet printers have been typically known as ink jet recorders for use in recording characters, images etc., on recording media such as paper etc., with ejected ink.

As shown in FIG. 8, a typical ink jet printer uses an ink cartridge P1 for storage of ink which can be removably mounted in a recording head unit P3 having a recording head P2, so that ink cartridge P1 is attached to recording head P2 by mounting it to recording head unit P3. The mounted ink cartridge P1 supplies recording head P2 with ink, which in turn is ejected from an ejection nozzle P4 provided in recording head P2, thus performing printing of characters etc. Provided inside recording head P2 is ink channels (not shown) which are defined with side-walls made up of piezoelectric elements so that ink compressed by the alternation of the intra-channel volume will be ejected from nozzle P4.

When predetermined conditions are satisfied during the operation of the ink jet printer, for example, automatically or by user interaction, ejecting nozzle P4 is subjected to a so-called purging operation, by which ink inside nozzle P4 is sucked from the ejection side of ejecting nozzle P4, that is, nozzle tip P5 having openings or ejection holes (not shown).

The specific operation of purging comprises: covering nozzle tip P5 with a suction cap P6; applying a negative pressure within suction cap P6 by an unillustrated suction pump; and sucking the ink from ink cartridge P1 and recording head P2 by way of suction cap P6 so as to displace the ink to the outside.

This purging operation is performed when an unused ink cartridge P1 is replaced or initially attached, in order to initially introduce the ink inside unused cartridge P1 into recording head P2. Alternatively, it is also performed in order to prevent mal-ejection of ink during the operation of the ink jet printer. A purging operation for the former purpose in particular is referred to as an initial purge or initial ink introduction purge.

When the user has mounted an unused ink cartridge P1 as a replacement or for initial setup, air will enter recording head P2. More specifically, there is a commutation passage between the ink feed port on the ink cartridge P1 and the ink inlet port on the recording head P2, and air will enter this commutation passage when ink cartridge P1 is mounted into recording head P2.

In a typical configuration, a filter is provided at the ink inlet port of recording head P2, aimed mainly at the prevention of foreign substances entering recording head P2.

Accordingly, when the aforementioned purging operation (initial purge) is performed after replacement of an ink cartridge P1 so that ink is rapidly sucked from the nozzle tip P5 of ejection nozzle P4 by means of suction cap P6, air within the aforementioned commutation passage rushes in and passes through the filter attached at the ink inlet port of recording head P2, generating a number of air bubbles. The air bubbles rapidly mix with the ink inside recording head P2, resultantly leaving air bubbles inside the ink channels and ejection nozzle P4.

In general, when ink jet printers of this type are shipped from the factory, recording head P2 is charged with a liquid for preservation (to be referred to as a storage solution) having properties similar to the ink but containing no pigment and dye.

For this reason, also when the aforementioned purging operation is performed after the user has initially attached an ink cartridge P1 to recording head P2, air inside the aforementioned commutation passage rushes in and passes through the filter attached at the ink inlet port of recording head P2, and the air rushes in and mixes with the ink inside recording head P2, resultantly generating a great deal of air bubbles and hence leaving the air bubbles inside the ink channel and ejection nozzle P4.

In ink jet printers of this type, there are cases where ink cartridge P1 has a filter at its ink feed port. This filter prevents entrance of foreign substances inside cartridge P1 into recording head P2 and also prevents ink leakage by making use of the surface tension of ink acting on the pores of the filter. Also in this case, when, upon the implementation of purging, ink inside ink cartridge P1 rushes through the filter provided at the ink feed port, into the aforementioned commutation passage containing air, a great number of air bubbles will be generated, resultantly leaving the air bubbles inside the ink channels and ejection nozzle P4.

Air bubbles remaining inside the ink channels and ejection nozzle P4 hinder the increase in pressure for ink to be ejected out, causing mal-ejection and hence degradation of recording image.

SUMMARY OF THE INVENTION

In view of what has been discussed above, it is therefore an object of the present invention to provide an ink jet recorder which can prevent residual air bubbles within the recording head after replacement or initial attachment of an ink cartridge.

In accordance with one aspect of the invention, an ink jet recorder is provided which comprises: a recording head having an ink inlet port, a filter provided at the ink inlet port and a nozzle for ejecting ink onto recording media; an ink cartridge detachably attached to the recording head for supplying ink to the inlet port of the recording head; a purging device for purging the nozzle from the exterior of the recording head; a carriage for holding the recording head and conveying it across the width of a recording medium and an area outside thereof; an ink receiver disposed in the area outside the width of the recording medium, for receiving ink ejected for flushing; and a controller which controls the carriage and recording head in such a manner that, before purging is started by the purging device, the carriage is moved to a position where the recording head opposes the ink receiver and therein the recording head ejects ink for flushing.

The ink jet recorder of the invention, is configured so that the controller makes the nozzle active so as to eject ink toward the ink receiver for flushing operation before the purging device starts actual purging. Therefore, in accordance with the ink jet recorder of the invention, after replacement or initial attachment of an ink cartridge, initial introduction of ink can be completed successfully without leaving any air bubbles within the recording head.

As has been already described, in an ink jet printer of this type, when the ink cartridge is attached to the recording head, air will enter the joint passage between the ink feed port of the ink cartridge and ink inlet port of the recording head for receiving the ink supply from the ink feed port. Therefore, if purging is performed immediately after replacement or initial attachment of an ink cartridge as in the conventional configuration, the air having entered the joint passage will rush in and pass through the filter attached to the ink inlet port of the recording head, and mix rapidly with the liquid (ink or the aforementioned storage solution), producing a great deal of air bubbles. Further in the case where a filter is also attached to the ink feed port of the ink cartridge, ink inside the ink cartridge will rush in and pass through the filter attached at the ink feed port of the ink cartridge, and rapidly mix with the air within the joint passage, producing a further increased amount of air bubbles.

In contrast, in the ink jet recorder of the invention, the controller controls the recording head and carriage so as to perform the flushing operation by ejecting ink toward the ink receiver before purging. Therefore, even if air has entered the joint passage between the ink feed port of the ink cartridge and the ink inlet port of the recording head during attachment of the ink cartridge to the recording head, the air within the joint passage and the ink inside the ink cartridge can be moved to the recording head side, for example a manifold thereof by ink ejection performed prior to purging. The movement of the air occurs at a very gentle speed which would be unfeasible using a suction pump, because a negative pressure in the joint passage produced when the flushing is performed by ejecting ink toward the ink receiver is generally lower than that produced when the purging device purges the nozzle.

Consequently, in accordance with the ink jet recorder of the invention, in the case where the ink inlet port of the recording head for receiving the ink supply from the ink feed port of the ink cartridge has a filter (to be referred to hereinbelow as filter Fa), air having entered the joint passage is moved into the recording head, by making the air pass through filter Fa at a gentle speed so as not to generate a number of air bubbles, so that purging can be implemented under conditions in which no air resides on either side of filter Fa. As a result, it is possible to prevent rapid mixing of air with the liquid in front of and behind filter Fa while purging is performed. Thus, it is possible to remarkably inhibit the generation of air bubbles during purging after replacement or initial attachment of an ink cartridge.

In accordance with the ink jet recorder of the invention, also in the case where the ink cartridge has a filter (to be referred to hereinbelow as filter Fb) provided at the ink feed port thereof, ink inside the ink cartridge can be moved to the joint passage by making the ink pass through filter Fb at a gentle speed so as not to generate air bubbles, so that purging can be implemented under conditions in which no air resides on either side of filter Fb. As a result, it is possible to prevent rapid mixing of air with the liquid in front of and behind filter Fb while purging is performed. Thus, it is possible to remarkably inhibit the generation of air bubbles during purging after replacement or initial attachment of an ink cartridge. In this document, the term "joint passage" means a passage formed between the filter Fb provided at the ink feed port on the ink cartridge and the filter Fa provided at the ink inlet port on the recording head if the recording head and the cartridge have these filters, respectively.

The amount of ink to be ejected during the operation of the controller may be set as follows: That is, the ink jet recorder is configured so that the controller controls the recording head in such a manner that the recording head ejects flushing ink in an amount greater than the volume of the passage defined by the ink feed port and the ink inlet port when the ink cartridge is mounted on the recording head. In accordance with the ink jet recorder having this configuration, air residing within the joint passage between the ink feed port of the ink cartridge and the ink inlet port of the recording head can be assuredly be drawn into the recording head before purging is started so that it is possible to fill with ink both sides of filter Fa attached at the ink inlet port of the recording head as well as both sides of filter Fb attached at the ink feed port of the ink cartridge. Accordingly, it is possible to reliably inhibit the generation of air bubbles after purging has been performed.

It is possible to configure the controller so as to perform driving of the recording head for flushing every time prior to implementation of purging. However, it is more efficient and advantageous if the driving of the recording head is adapted to be performed only when purging is first performed after the attachment of the ink cartridge to the recording head. As a result flushing operation will be performed only in a state where air has entered the joint passage between the ink cartridge and the recording head, e.g., after replacement of an ink cartridge, after initial attachment of an ink cartridge or any other reason. Therefore, it is possible to minimize the ejected amount of ink from the nozzle for reasons other than recording onto recording media as well as to minimize the time to be spent for purging.

DESCRIPTION OF THE PREFERRED EMBODIMENT

Now, the ink jet printer to which the embodiment of the invention is applied will be described with reference to the accompanying drawings. It should be noted that the present invention will not be limited to the embodiment described hereinbelow, and can be realized in various forms as long as it belongs to the scope of the claims of the present application.

Figure 1:
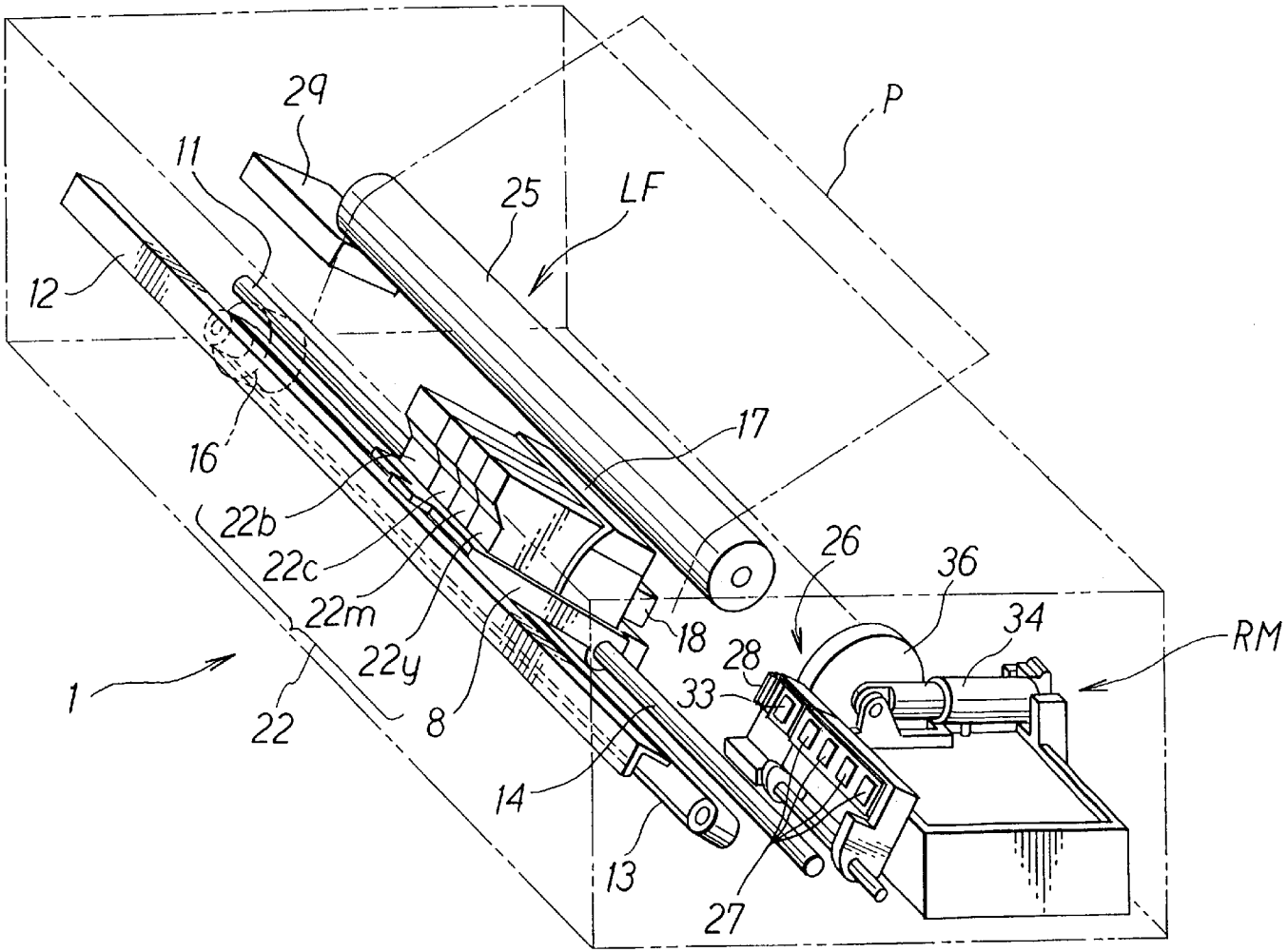
FIG. 1 is an illustrative view showing the interior construction of an ink jet printer of an embodiment.

First, FIG. 1 is an illustrative view showing the interior construction of an ink jet printer 1 in accordance with this embodiment.

As shown in FIG. 1, in ink jet printer 1, a carriage 8 is slidably supported by a guide rod 11 and guide member 12 while fixed to a belt 13 so that it can be driven by a CR motor (carriage drive motor) 16 to move in a reciprocating manner. Attached to this carriage 8 is a recording head unit 17 having a recording head 18 for performing recording such as printing characters etc.

This recording head unit 17 is an ink jet type to achieve recording by ejecting four colors of ink (cyan c, magenta m, yellow y and black b where the alphabetical symbols c, m, y and b represent cyan, magenta, yellow and black, respectively) onto a recording sheet of paper P as the recording medium.

Figure 2:
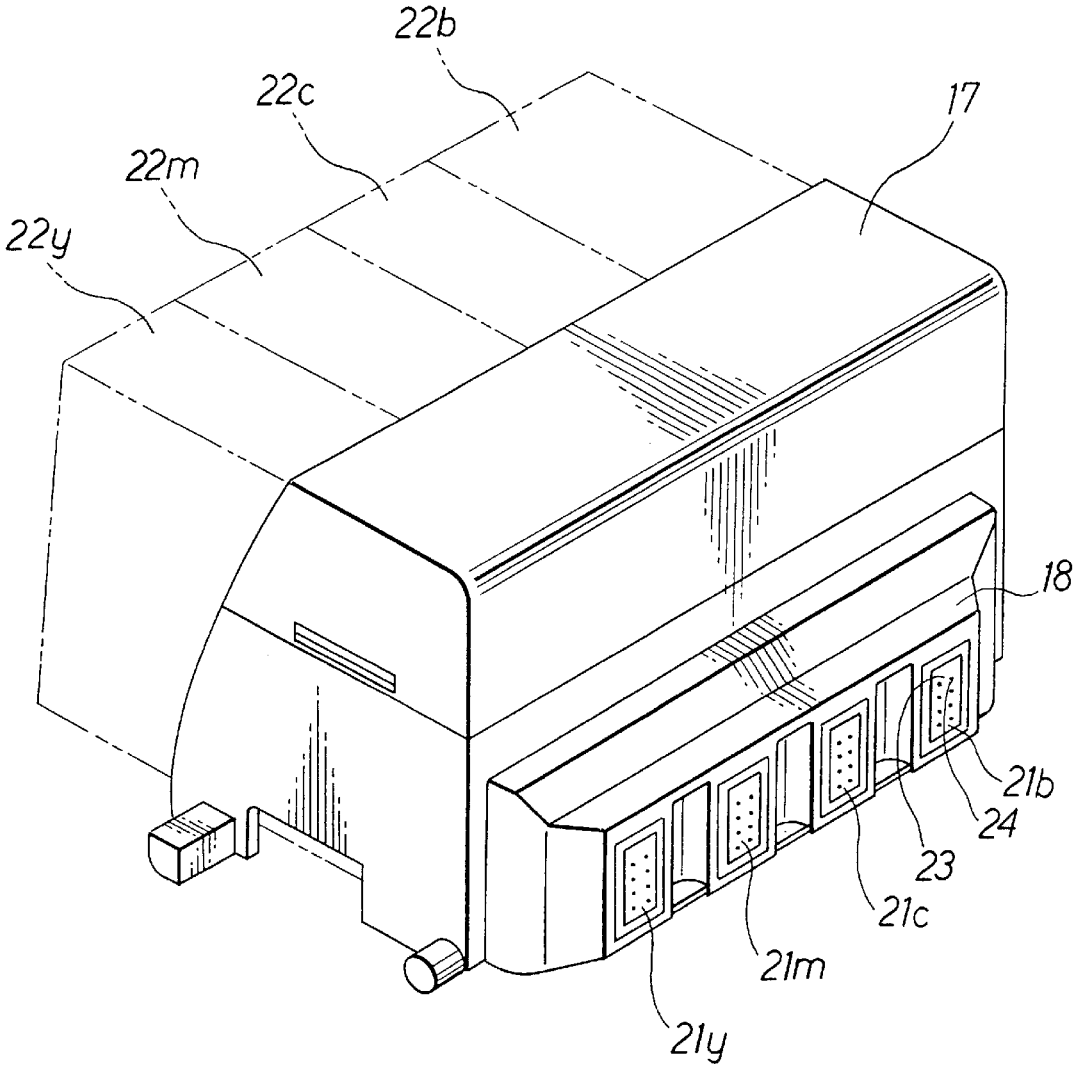
FIG. 2 is a perspective view showing a recording head unit of an embodiment.

Recording head 18 located on the recording side of recording head unit 17, has four ejection heads 21*y*, 21*m*, 21*c* and 21*b* (which will be generally referred to as ejection heads 21 hereinbelow) in order to eject the respective colors of ink, as shown in FIG. 2. Each ejection head 21 has an ejection surface 23 with many (e.g. 64) ejection holes (nozzles) 24 as openings. As indicated by two-dot chain lines in FIG. 2, four ink cartridges 22*y*, 22*m*, 22*c* and 22*b* (which will be generally referred to as ink cartridges 22 hereinbelow) for supplying respective nozzles 21 with associated ink, are removably attached to the cartridge mounting port formed on the side of recording head unit 17 opposite recording head 18 (on the left side in FIG. 2).

Figure 3:
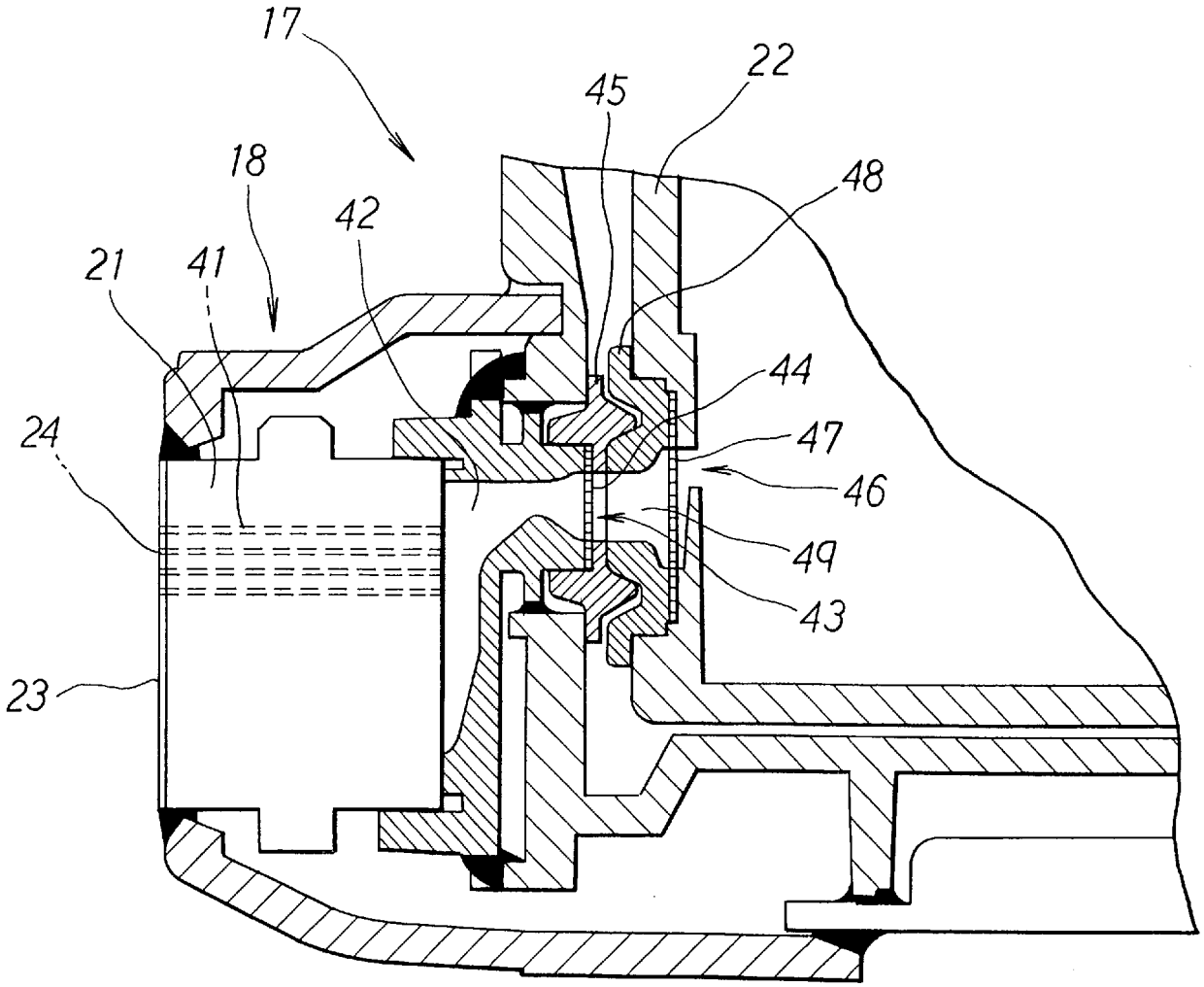
FIG. 3 is an illustrative sectional view showing the state in which an ink cartridge is attached to a recording head unit.

Referring to FIG. 3, each ejection head 21 provided for recording head 18 of recording head unit 17 is structured of a well-known actuator which is formed by machining piezoelectric material, and has many ink ejection passages therein, which will be referred to as channels 41. Each channel 41 is connected to an ink ejection hole 24 on the end face, i.e., on the ejection surface 23 side (the left side in FIG. 3).

All channels 41 of ejection head 21 communicate at their ink in-flow side end (on the right side in FIG. 3) with a manifold 42 provided inside recording head 18. This manifold 42 has an opening, i.e., ink inlet port 43 for recording head 18, with a mesh-like filter 44 covering the opening in order to prevent foreign substances such as dust etc. from entering recording head 18. Fixed around the outer rim of filter 44 is an approximately annular joint 45 made up of elastic material such as rubber etc.

In recording head 18 of recording head unit 17, the aforementioned manifold 42, ink inlet port 43, ink filter 44 and joint 45 are provided for each ejection head 21.

As seen in FIG. 3, ink cartridge 22 has an ink feed port 46, at which a mesh-like filter 47 aimed primarily at preventing ink leakage is pressed and fixed in front of joint 45, by means of an approximately annular, resin-made adapter 48.

In this configuration of recording head unit 17, when ink cartridge 22 is mounted, adapter 48 of ink cartridge 22 comes in close contact with joint 45 of recording head 28, as seen in FIG. 3, and thus the attachment of an ink cartridge 22 to recording head 18 is completed. Then, ink is supplied from ink feed port 46 of ink cartridge 22 to ink inlet port 43 of recording head 18 by way of the joint passage (designated at 49) defined by the hollow of adapter 48 and the hollow of joint 45. The thus fed ink is supplied from manifold 42 inside recording head 18 to all channels 41 of ejection head 21. Voltages are applied to ejection head 21 so as to change the passage widths of channels 41 to thereby eject ink through selected ejection holes 24.

In this embodiment, the volume of manifold 42 formed inside recording head 18 is designed to be greater than the volume of joint passage 49 which is formed when ink cartridge 22 is attached to recording head 18. The reason for manifold 42 having a greater volume than joint passage 49 is to maintain a sufficient volume in manifold 42 to trap air having moved from joint passage 49 when flushing is performed. In addition, when ink jet printer 1 is shipped from the factory, the interior of recording head 18, including channels 41 and manifold 42 for each ejection head 21 is filled up with a storage solution.

Returning to FIG. 1, a conveyer mechanism LF for conveying a recording sheet of paper P is provided at a position opposite recording head 18. This conveyer mechanism LF is driven by an LF motor (conveyer motor) 30 (see FIG. 5) so as to rotate a platen roller 25, which, as it rotates, conveys a recording sheet of paper P.

Provided on one side is a maintenance/restoration mechanism RM for maintaining and restoring the ink ejecting operation of recording head 18.

This maintenance/restoration mechanism RM comprises: a suction device 26; preservation caps 27 covering individual ejection surfaces 23 of ejection heads 21 so as to prevent dryout of ink when ink jet printer 1 is unused; and a wiper 28 for wiping ejection surfaces 23 of ejection heads 21. Here, this suction device 26 functions to implement initial introduction of ink from a newly mounted ink cartridge 22 into recording head 18 upon its replacement or its initial setup, and also to solve the mal-ejection of ink occurring due to dryout of ink, mixing of air bubbles into the ink, ink droplets adhering to ejection surface 23 of ejection heads 21 and/or any other malfunctions occurring during the operation of ink jet printer 1.

Figure 4:
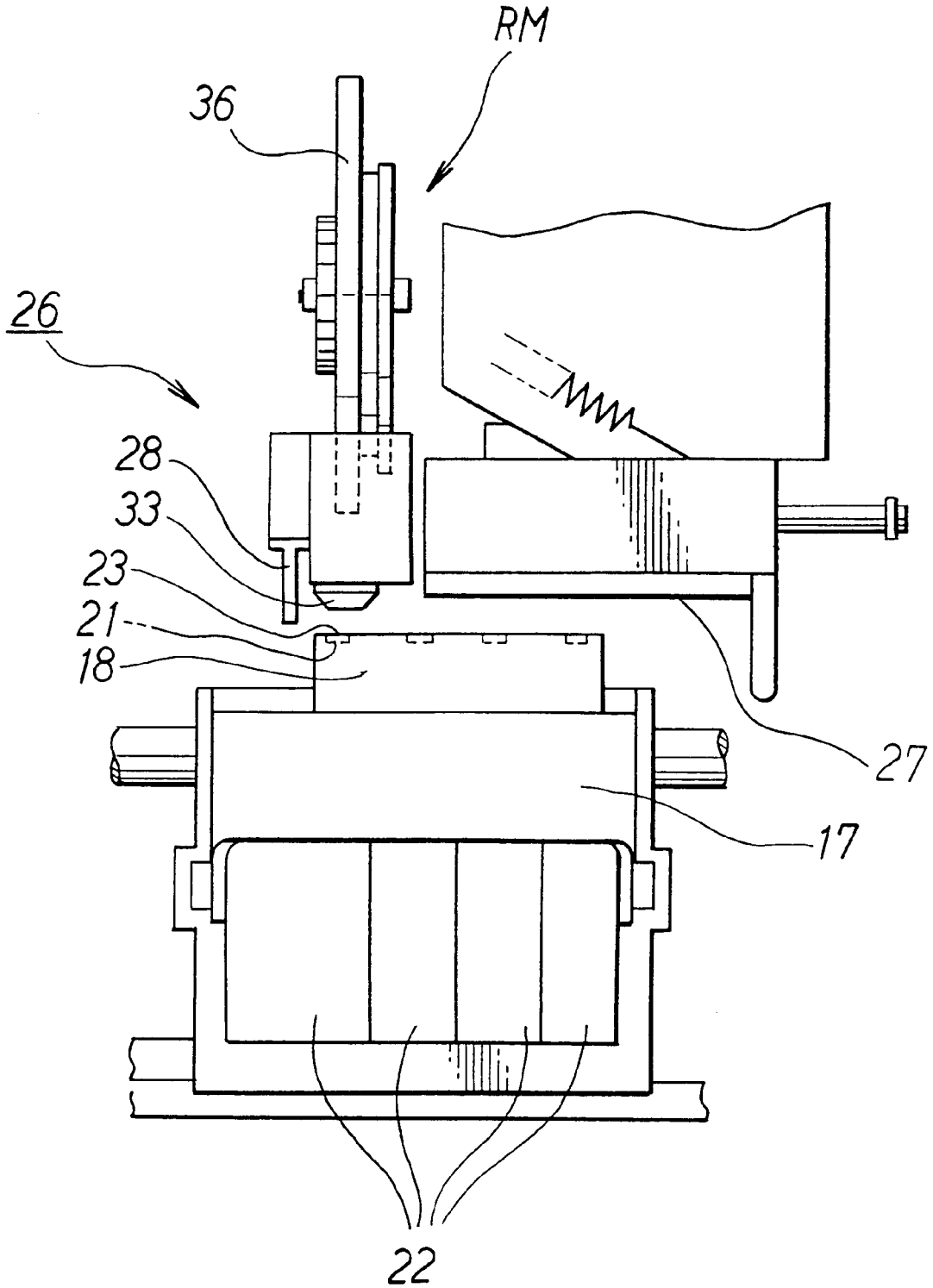
FIG. 4 is an illustrative view showing the configuration of a suction device of an embodiment.

Suction device (or purging device) 26 includes: as shown in FIGS. 1 and 4, a suction cap 33 which can come into and out of close contact with ejection surface 23 of each ejection head 21 of recording head 18; and a suction pump 34 for sucking ink through suction cap 33 when suction cap 33 is in close contact with recording head 18. In this suction device 26, a cam member 36 which is driven by a cam drive motor 35 (see FIG. 5), moves suction cap 33 and wiper 28 forward to recording head 18, and then suction pump 34 is activated to achieve the operation of sucking (or purging) through suction cap 33.

Wiper 28 is located on the suction cap 33 side, as shown in FIGS. 1 and 4, and is used to wipe off the ink having adhered on ejection surfaces 23 of ejection heads 21.

Further, as shown in FIG. 1, collecting member (ink receiver) 29 made up of porous material for collecting waste ink is provided on the side opposite to maintenance/restoration mechanism RM, with conveyer mechanism LF therebetween. This collecting member 29 is used for a flushing operation in which, ink is ejected with ejection head 21 set to collecting member 29 so as to remove air bubbles and/or mixed color ink residing within the interior of recording head 18.

Figure 5:
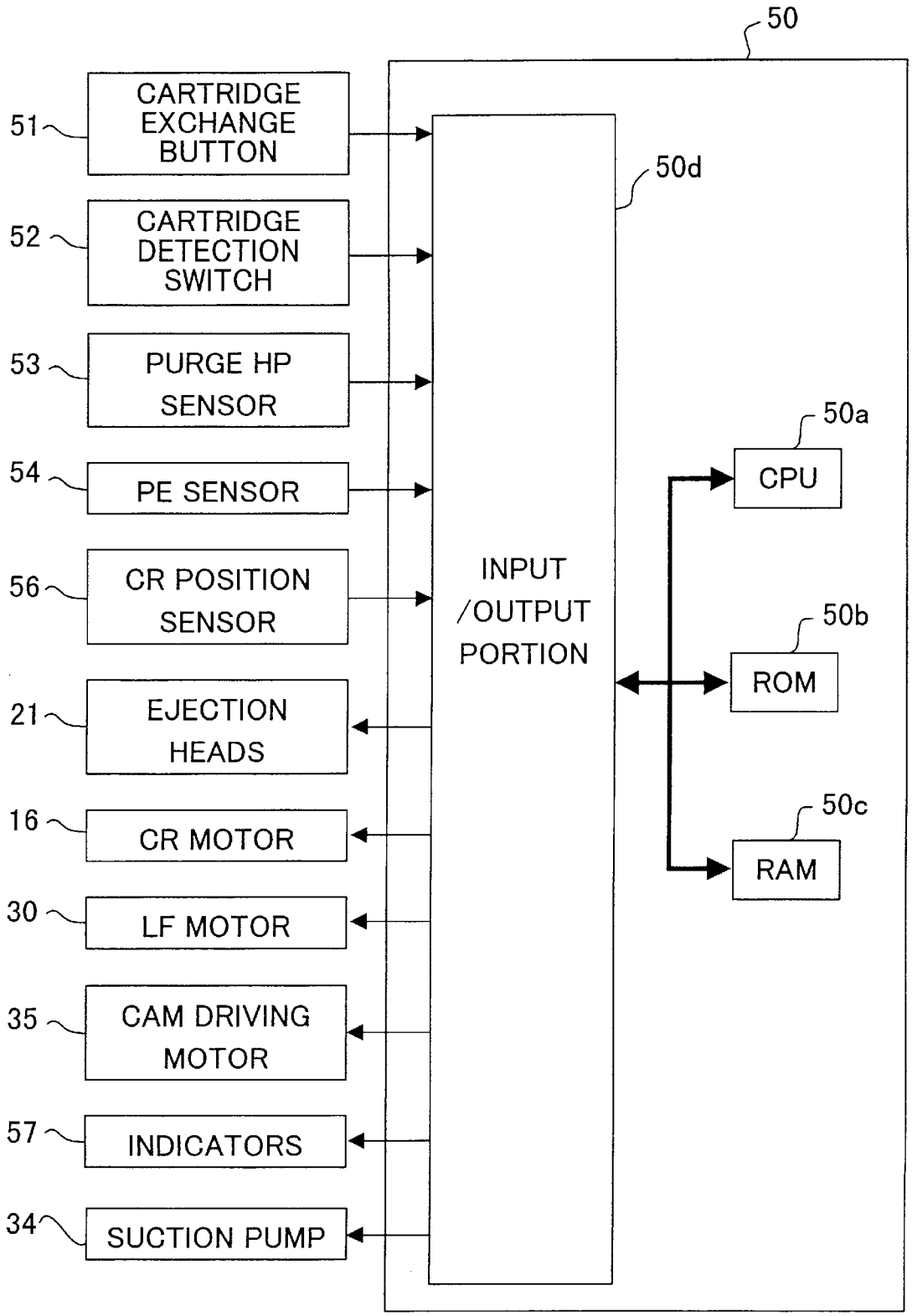
FIG. 5 is a block diagram showing an electric configuration of an ink jet printer of an embodiment.

Referring next to FIG. 5, the electric configuration of ink jet printer 1 will be explained.

As shown in FIG. 5, a controller 50 for controlling the operation of ink jet printer 1 is essentially composed of a well-known microcomputer having a CPU 50*a*, a ROM 50*b* and a RAM 50*c* and an input/output portion 50*d*, etc.

Connected to input/output portion 50*d* are: a cartridge replacement key 51 which the user will press for replacement of an ink cartridge 22 or when a fresh ink cartridge 22 is attached for initial setup; switches through which the user can instruct suction device 26 to start a sucking operation; cartridge sensing switches 52 for detecting whether cartridges 22 are mounted or not; a purge HP sensor 53 for detecting whether suction pump 34 is in its home position; a PE sensor 54 for detecting the leading edge of recording sheet of paper P; a CR position sensor 56 for detecting the position of carriage 8.

Cartridge sensing switches 52, are provided in the aforementioned cartridge mounting portion of recording head unit 17, one for each ejection head 21, and each cartridge sensing switch will be turned on when the associated ink cartridge 22 is mounted and adapter 48 on ink cartridge 22 fits in close contact with joint 45 of recording head 18.

Connected further to input/output portion 50*d* are: ejection heads 21, especially actuators formed therein for ejecting ink; CR motor 16 for moving carriage 8; LF motor 30 for driving conveyer mechanism LF; cam drive motor 35 driving cam member 36 for moving suction device 26; indicators for displaying the current operation conditions etc.; suction pump 34 for sucking ink through suction cap 33, and the like.

Referring next to flowcharts shown in FIGS. 6 and 7, description will be made of the processing sequence of controller 50, which is implemented in the thus configured ink jet printer 1 of this embodiment when the user replaces one ink cartridge 22 associated with one of ejection heads 21, or when the user mounts one ink cartridge 22 associated with one of ejection heads 21 for initial setup.

Figure 6:
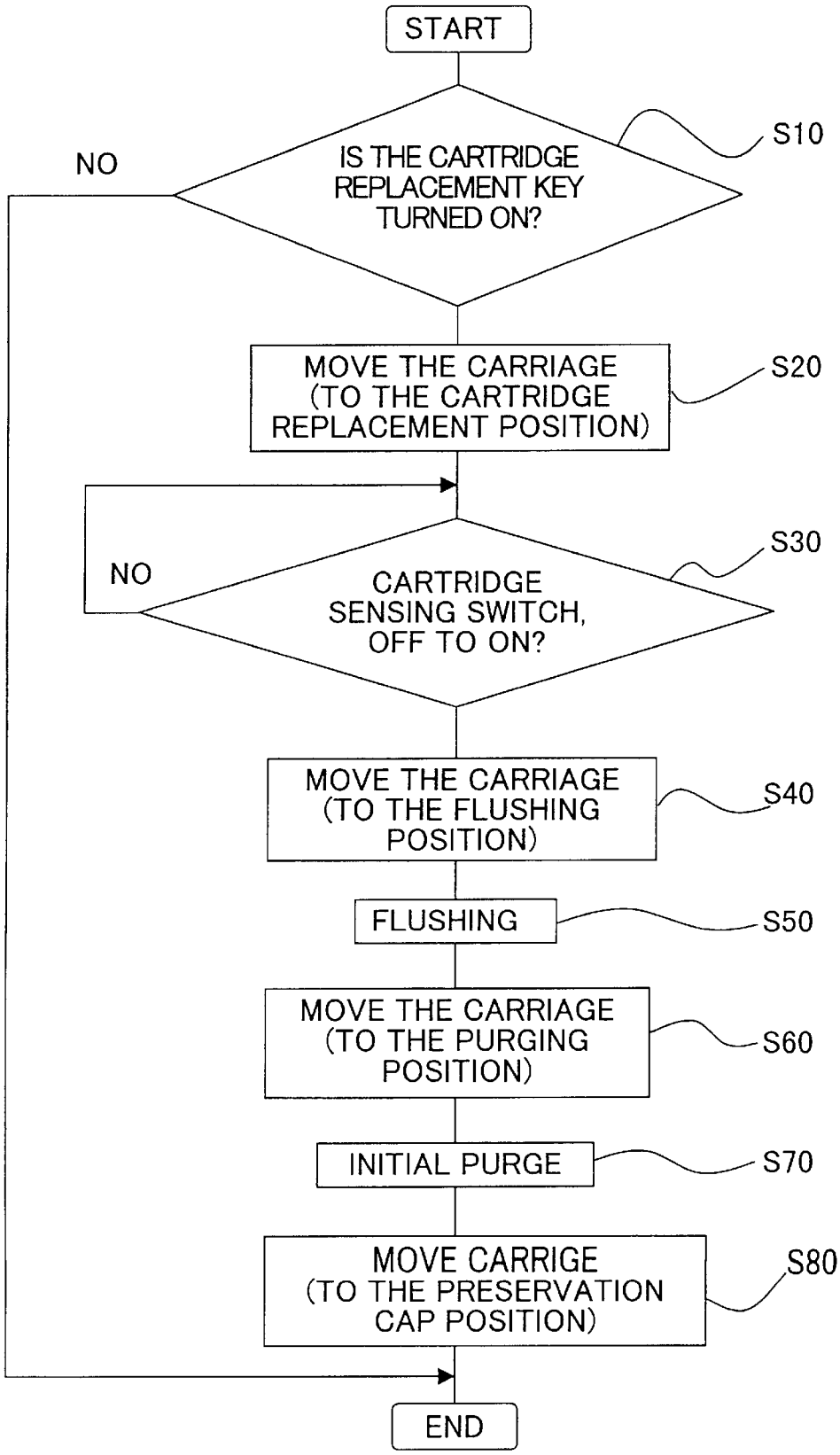
FIG. 6 is a flowchart showing the control operation to be performed in the controller of an embodiment.

Controller 50 implements the control sequence shown in FIG. 6, repeatedly every predetermined period of time. When this control is started, first, it is judged at Step (to be abbreviated as S, hereinbelow) 10 whether cartridge replacement key 51 is pressed and turned on by the user. If the judgment is negative (S10: No), the control process is ended without performing anything.

On the other hand, if it is determined at S10 that cartridge replacement key 51 is turned on (S10: Yes), carriage 8 is moved to the cartridge replacement position at the following step, i.e., S20. More specifically, whilst the position of carriage 8 is detected based on the signal from CR position sensor 56, CR motor 16 is operated so as to move carriage 8 to the predetermined cartridge replacement position.

When carriage 8 has been thus moved to the cartridge replacement position, the operation is waited for at S30 until any of cartridge sensing switches 52 change from the OFF-state to the ON-state.

When, at S30, it is determined that one of cartridge sensing switches 52 has changed from the OFF-state to the ON-state (S30: Yes), the system determines that the ejection head 21 associated with the cartridge sensing switch 52 which has been turned on, has been fitted with new ink cartridge 22 as a replacement or as the initial setup. Then this operation is followed by S40 where carriage 8 is moved to the position (to be referred to as flushing position) where ejection heads 21 face collecting member 29 shown in FIG. 1, in the same procedure as in S20.

When carriage 8 has been moved to the flushing position in the above way, all channels 41 of ejection head 21 (the ejection head 21 for which replacement or initial setup of an ink cartridge 22 has been made, and which will be hereinbelow referred to as initial purge target ejection head 21) corresponding to the cartridge sensing switch 52 which has been determined at S30 as having changed to the ON-state are activated only during a predetermined time T, so as to eject ink from the initial purge target ejection head 21, toward collecting member 29, or perform an operation of flushing. Here, in this embodiment the predetermined time T is set up to be equal to the time required for ink in an amount equal to the volume of manifold 42, to be ejected. This is because ink, which contains air and is located in joint passage 49, should be conveyed into manifold 42 by the flushing operation.

Next, at S60, in the same procedure as S20 described above, carriage 8 is moved to the position (to be referred to hereinbelow as purge position) where the initial purge target ejection head 21 opposes suction cap 33. When carriage 8 has been moved to the purge position, a purging operation (an initial purge) shown in FIG. 7 will be implemented following S70, for purging initial purge target ejection nozzle 21.

Figure 7:
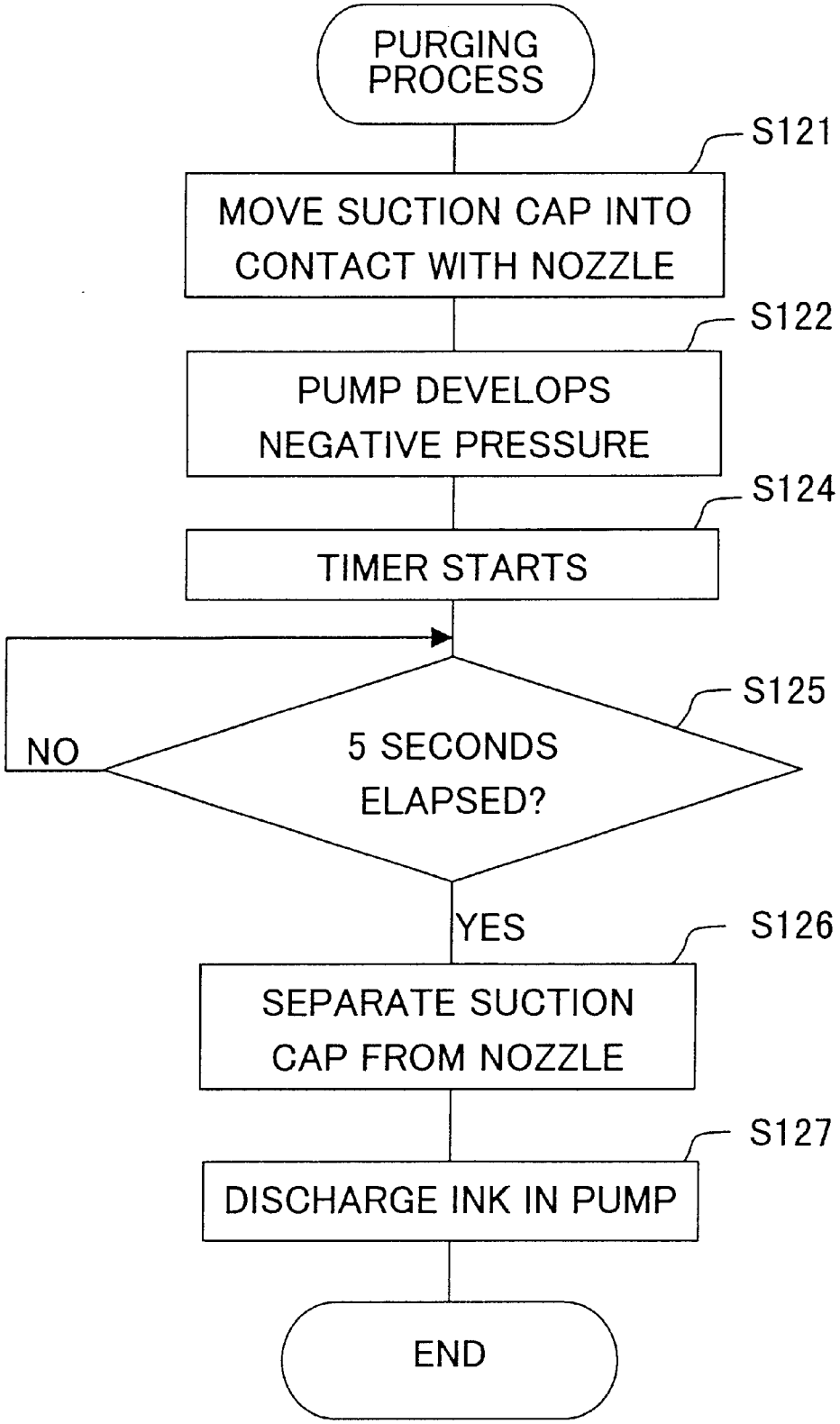
FIG. 7 is a flowchart showing the purging operation performed by the controller of an embodiment.
Figure 8:
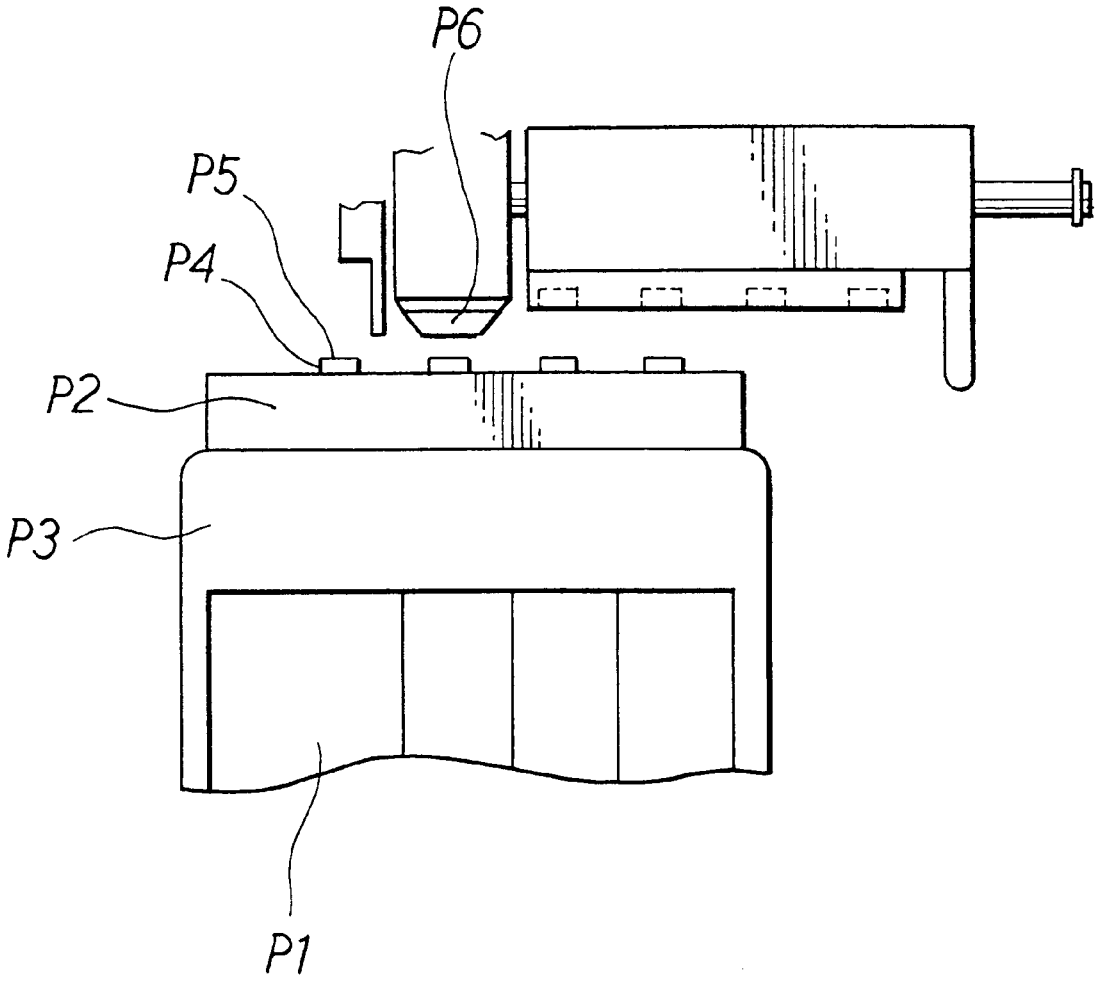
Fig. 8 PRIOR ART
FIG. 8 is an illustrative view showing the configurations of a recording head unit and ink suction device of a conventional ink jet printer.

Once this purging is started, first, at S121 shown in FIG. 7, cam drive motor 35 is activated so that suction cap 33 comes into close contact with ejection surface 23 of the initial purge target ejection head 21. Subsequently, at S122, suction pump 34 is activated to generate a negative pressure within suction cap 33. This generation of negative pressure causes suction pump 34 to suction ink from ejection surface 23 of the initial purge target ejection head 21 via suction cap 33.

Next, at S124, upon the generation of a negative pressure, the built-in timer in the micro computer is started so as to clock the suction time of ink.

At S125, when it is determined that 5 seconds, for example, has elapsed, the operation goes to S126 where the operation of suction pump 34 is stopped while cam drive motor 35 is activated so that suction cap 33 is pulled away from ejection surface 23 of the initial purge target ejection head 21. Then, at the final step, i.e. S127, the ink which has been sucked from ejection surface 23 of the ejection head 21 during the steps S122 to S125 is discharged outside of suction pump 34 to end the purging operation.

The end of the purging operation shown in FIG. 7 is followed by S80 of FIG. 6, where carriage 8 is moved to the preservation cap position in the same procedural order as in S20. Here, at the preservation cap position, carriage 8 will be located so that all nozzles 21 of recording head 18 oppose respective caps 27 (four caps in FIG. 1). After carriage 8 has been moved to the preservation cap position, this control is ended.

Returning to FIG. 6, in the case where the user replaced more than one ink cartridge 22 corresponding to ejection heads 21 or mounted more than one fresh cartridges as the initial setup at the step S20 where carriage 8 had been moved to the cartridge replacement position, all the ejection heads 21 which correspond to the replaced or newly mounted ink cartridges 22 are made active for predetermined time T, at S50 in FIG. 6. Then, the operations for initial purge at S60 and S70 in FIG. 6 are successively performed for each of the ejection heads 21.

In ink jet printer 1 of this embodiment, the purging operation shown in FIG. 7 will also be performed when other purge execution conditions are satisfied, other than the timing of S70 of FIG. 6. Examples of these conditions include cases where the aforementioned purge key is operated to command the execution of purging of any of ejection heads 21, and where the cumulative usage time of the ink jet printer 1 reaches a predetermined time.

In this embodiment, the CPU serves as the purge controller.

As has been detailed, in ink jet printer 1 in accordance with this embodiment, when replacement of ink cartridge(s) 22 or newly mounting of ink cartridge(s) 22 has been detected based on the ON/OFF state of cartridge sensing switch(es) 52 (S30: Yes), purging (initial purge) of suction device 26 is performed for ejection head(s) 21 corresponding to replaced or newly mounted ink cartridge(s) 22 (S60, S70). In particular, ejection head(s) 21 is/are adapted to be made active to eject ink for the predetermined time T before execution of the initial purge (S40, S50).

Therefore, in accordance with ink jet printer 1 of this embodiment, after replacement of an ink cartridge(s) 22, or after initial attachment of an ink cartridge(s) 22, initial introduction of ink can be completed without leaving any air bubbles within ejection head(s) 21.

Illustratively, when the user mounts ink cartridge 22 into recording head 18, air will enter joint passage 49 (see FIG. 3) between ink feed port 46 of ink cartridge 22 and ink inlet port 43 of recording head 18. If purge is directly performed after replacement of ink cartridge 22 or after initial attachment of an ink cartridge 22, the air having entered the joint passage 49 rushes in and passes through filter 44 attached at ink inlet port 43 of recording head 18, and/or rapidly mixes with the liquid (the ink or the aforementioned storage solution inside manifold 42) inside recording head 18, producing many air bubbles. Further, the ink inside ink cartridge 22 rushes through filer 47 attached at ink feed port 46 of ink cartridge 22, and abruptly becomes mixed with air within joint passage 49, producing a further increased amount of air bubbles.

In contrast, in the case of ink jet printer 1 of this embodiment, before purging, ejection head 21 is made active for the predetermined time T required for ink in an amount equal to the volume of manifold 42, to be ejected. The negative pressure in the joint passage produced when the recording head ejects the ink for the flushing is lower than that produced when the purging device purges the nozzle. Accordingly, air having entered joint passage 49 during mounting ink cartridge 22 can be made to pass through filter 44 at a gentle speed which will not cause air bubbles to arise and be transferred into recording head 18 (more specifically, manifold 42), and at the same time, ink from newly mounted ink cartridge 22 can, pass through filters 47 and 44 at a gentle speed which will not generate air bubbles, and be transferred into recording head 18. Even though a small amount of air bubbles are generated in or transferred into the manifold, the air bubbles may be sucked out of the ejection heads 21 by the following purging operation.

In ink jet printer 1 of this embodiment, since purging is performed under the conditions in which no air exists on either side of filters 44 and 47, it is possible to prevent air and the liquid from mixing in front of and behind both filters 44 and 47 during purging. Thus, it is possible to markedly inhibit the generation of air bubbles during purging (initial purging) after replacement of an ink cartridge 22 or after initial attachment of an ink cartridge 22.

Accordingly, in accordance with ink jet printer 1 of this embodiment, while entrance of foreign substances into recording head 18 can be blocked by filter 44 attached at the ink inlet port 43 of recording head 18, leakage of ink from ink cartridge 22 can be prevented by filter 47 attached at ink feed port 46 of ink cartridge 22. And, it is also possible to remarkably inhibit generation of air bubbles when purging is performed after replacement of an ink cartridge 22 or after initial attachment of an ink cartridge 22.

Further, it is also possible to configure a system in which the implementation (driving of ejection head 21) of S40 and S50 in FIG. 6 is performed before every time purging operation shown in FIG. 7 is implemented. However, as in this embodiment, it is advantageous if the implementation of S40 and S50 of FIG. 6 is adapted to be performed only after replacement of an ink cartridge 22 or after initial attachment of an ink cartridge 22 (that is, only when the purging operation is first performed after attachment of an ink cartridge 22 to recording head 18). This is because, in this case, ejection head 21 can be made active only when air is contained within joint passage 49 between ink cartridge 22 and recording head 18, so that it is possible to save the amount of ink which will be ejected from ejection head 21 for purposes other than recording on a recording sheet of paper P.

Although the description of the above embodiment has been made in the case where the invention is applied to an ink jet printer, the present invention can be without doubt, applied in the same manner to other appliances using an ink jet type recording apparatus (such as facsimile machines).

What is claimed is:

1. An ink jet recorder comprising:

a recording head having an ink inlet port, a filter provided at the ink inlet port and a nozzle for ejecting ink onto a recording medium;

an ink cartridge detachably attached to the recording head for supplying ink to the inlet port of the recording head;

a purging device for purging the nozzle from the exterior of the recording head;

a carriage for holding the recording head and conveying it across the width of the recording medium and an area outside thereof;

an ink receiver disposed in the area outside the width of the recording medium, for receiving ink ejected for flushing; and a controller which controls the carriage and recording head in such a manner that, before purging is started by the purging device, the carriage is moved to a position where the recording head opposes the ink receiver and therein the recording head ejects ink for flushing.

2. The ink jet recorder according to claim 1, wherein the ink cartridge has an ink feed port connected to the ink inlet port of the recording head, a joint passage is defined between the ink feed port and the ink inlet port, a negative pressure in the joint passage produced when the recording head ejects the ink for the flushing is lower than that produced when the purging device purges the nozzle.

3. The ink jet recorder according to claim 2, wherein the ink cartridge has a filter provided at the ink feed port.

4. The ink jet recorder according to claim 2, wherein the controller controls the recording head in such a manner that the recording head ejects the ink for flushing in an amount greater than the volume of the joint passage.

5. The ink jet recorder according to claim 1, wherein the controller controls the recording head in such a manner that the recording head ejects the ink for flushing only before the purging device performs a first purging after the ink cartridge has been attached to the recording head.

6. The ink jet recorder according to claim 1, wherein the purging device comprises a suction cap for covering the nozzle and a suction pump for sucking the ink within the recording head through the suction cap and the nozzle.

7. The ink jet recorder according to claim 3, wherein the recording head comprises an ink channel and a manifold at the end of which the ink inlet port is defined, the ink channel communicates at one end thereof with the nozzle and communicates at the other end thereof with the manifold, and the volume of the manifold is greater than that of the joint passage.

8. The ink jet recorder according to claim 1, wherein the recording head has a plurality of heads for ejecting different colors of ink, the controller controls the carriage with the recording head in such a manner that, for each head, the carriage is moved to a position where the head opposes the ink receiver before purging is started by the purging device, and therein the head ejects ink for flushing.

9. The ink jet recorder according to claim 1, further comprising a wiper for wiping the surface in which the nozzle of the recording head is formed.

10. The ink jet recorder according to claim 1, wherein the ink jet recorder is an ink jet printer.

11. An ink jet recorder comprising:

a recording head having an ink inlet port, a filter provided at the ink inlet port and a nozzle for ejecting ink onto a recording medium;

an ink cartridge detachably attached to the recording head for supplying ink to the inlet port of the recording head;

a purging device that purges the nozzle from an exterior of the recording head;

a carriage that holds the recording head and conveys the recording head across the width of the recording medium and an area outside thereof; and a controller that controls the carriage and recording head such that the recording head ejects ink for flushing before purging is started by the purging device.

12. The ink jet recorder according to claim 11, wherein the ink cartridge has an ink feed port connected to the ink inlet port of the recording head, a joint passage is defined between the ink feed port and the ink inlet port, and a negative pressure in the joint passage produced when the recording head ejects the ink for the flushing is lower than that produced when the purging device purges the nozzle.

13. The ink jet recorder according to claim 12, wherein the controller controls the recording head in such a manner that the recording head ejects the ink for flushing in an amount greater than a volume of the joint passage.

14. The ink jet recorder according to claim 11, wherein the controller controls the recording head in such a manner that the recording head ejects the ink for flushing only before the purging device performs a first purging after the ink cartridge has been attached to the recording head.

15. An ink jet recorder comprising:

a recording head having an ink inlet port, a filter provided at the ink inlet port and a nozzle for ejecting ink onto a recording medium;

an ink cartridge detachably attached to the recording head for supplying ink to the inlet port of the recording head;

a purging device that purges the nozzle from an exterior of the recording head;

a carriage that holds the recording head and conveys the recording head across the width of the recording medium and an area outside thereof; and a controller that controls the carriage and recording head so that the recording head ejects ink for flushing before purging is started by the purging device and after the ink cartridge is exchanged and the ink passes through the filter with an ink speed that prevents the ink from generating air bubbles therein.

16. The ink jet recorder according to claim 15, wherein the ink cartridge has an ink feed port connected to the ink inlet port of the recording head, a joint passage is defined between the ink feed port and the ink inlet port, and a negative pressure in the joint passage produced when the recording head ejects the ink for the flushing is lower than that produced when the purging device purges the nozzle.

17. The ink jet recorder according to claim 16, wherein the recording head comprises an ink channel and a manifold at an end of which the ink inlet port is defined, the ink channel communicates at one end thereof with the nozzle and communicates at another end thereof with the manifold, and the controller controls the recording head in such a manner that the recording head ejects the ink for flushing for a time period required for ejecting an ink amount corresponding to a volume of the manifold.

18. The ink jet recorder according to claim 17, wherein the volume of the manifold is greater than that of the joint passage.

* * * * *